United States Patent [19]

Ishikawa

[11] Patent Number: 4,625,770

[45] Date of Patent: Dec. 2, 1986

[54] METHOD AND APPARATUS FOR MONITORING WEFT INSERTION IN A FLUID JET LOOM

[75] Inventor: Mamoru Ishikawa, Kariya, Japan

[73] Assignee: Kabushiki Kaisha Toyoda Jidoshokki Seisakusho, Kariya, Japan

[21] Appl. No.: 729,405

[22] Filed: May 1, 1985

[30] Foreign Application Priority Data

Jun. 29, 1984 [JP] Japan ..... 59-135686
Jun. 29, 1984 [JP] Japan ..... 59-135687

[51] Int. Cl.[4] ..... D03D 51/18

[52] U.S. Cl. ..... 139/336; 139/435; 139/370.2

[58] Field of Search ..... 139/435; 226/97; 139/336 R, 370.2

[56] References Cited

U.S. PATENT DOCUMENTS 4,392,517 7/1983 Takahashi ..... 139/435
4,410,016 10/1983 Manders ..... 139/435
4,446,893 5/1984 Gunnemann et al. ..... 139/435
4,550,753 11/1985 Tsuji ..... 139/435

*Primary Examiner*—Henry S. Jaudon
*Attorney, Agent, or Firm*—Brooks, Haidt, Haffner & Delahunty

[57] ABSTRACT

According to the present invention, the respective fluid pressures at the output sides of the plural jet fluid valve units in a fluid jet loom are converted into electrical signals by respective pressure detection elements such as piezo-electric elements. An alarm lamp or buzzer is activated or the loom operation stopped unless all of the electrical signals supplied from the pressure detection elements associated with the valve units reach preset values.

10 Claims, 10 Drawing Figures

METHOD AND APPARATUS FOR MONITORING WEFT INSERTION IN A FLUID JET LOOM

BACKGROUND OF THE INVENTION

This invention relates to a fluid jet loom in which the supply of a jet fluid used for insertion or the weft yarn into the warp shed, such as air or water, is controlled by a valve unit or valve units. More particularly, this invention relates to a method and an apparatus for monitoring the weft insertion in such loom.

In air jet looms, the weft yarn ejected from the weft yarn inserting main nozzle is introduced into a weft yarn guide passage defined by a so-called modified reed or a large number of weft yarn guide members juxtaposed on the slay. A plurality of auxiliary nozzles are provided along the guide passage to help the weft yarn to complete its travel or flight along the guide passage. The state of travel of the weft yarn being inserted in this manner is governed by tne weft inserting conditions such as fluid jet pressure or timing from the main or auxiliary nozzles. Unless these weft inserting conditions are controlled satisfactorily, such weft inserting error as the weft yarn deviating from the weft yarn guide passage or forming a loop in the guide passage during weft insertion will not be avoided, thus detracting considerably from the quality of the woven fabric.

Therefore, the timing of fluid ejection at the main or auxiliary nozzles need be controlled in accordance with the prevailing weaving conditions such as the kind of the weft yarn or the cloth width. Such control can be made by adjustment of the timing of opening or closing the valve units used for controlling the supply of the jet fluid to the respective nozzles. Such valve timing adjustment is done while checking the fluid pressure at the injection nozzle. For example, as disclosed in the Japanese laid-open Utility Model Publication No. 87372/1980, the foremost part of a connection tube from an air pressure gauge is sealingly connected to an ejection orifice of the auxiliary nozzle, and the valve opening timing is adjusted in such a manner that the pressure indicated on the gauge rises to the peak state at the loom rotation angle corresponding to the predetermined ejection start time at the auxiliary nozzle.

However, since such opening timing adjustment may be achieved while the loom is at a standstill it is not possible to make a check as to whether the fluid discharge is taking place in the preset manner during tne actual loom operation. Thus, when one of the valve units is used for controlling the fluid ejection at an auxiliary nozzle during the loom operation, the number of weft insertion errors may be increased drastically.

Such failure of the valve unit may be caused for example when the start signal for the magnetic solenoid is missing, or when a noise signal other than tne start signal is occasionally applied to cause the malfunction of the solenoid. In addition, the sliding valve piston may be burned resulting in an increased frictional resistance thus oostructing the smooth valve opening or closing operation. In a mechanical valve unit in which the valve is moved by a cam in the forward stroke and by a spring in the rearward stroke, there may be instances wherein, on account of the burned state of the valve piston, the spring force is not effective to cause the return movement of the valve piston.

However, it is difficult and time-consuming to deduce from the apparent increase in the number of weft inserting errors that the cause of trouble resides in the malfunction of the valve unit or units.

When the air pressure gauge is used for adjustment of the nozzle opening timing as mentioned hereinabove, the ejection port of the auxiliary nozzle is stopped by tne foremost part of the auxiliary nozzle so that the discharge fluid pressure in the auxiliary nozzle reaches a maximum in a snort time irrespective of the opening degree of the valve piston. Thus, the adjustment of the valve opening timing based on the peak indication on the pressure gauge is extremely difficult and requires great skill on the part of the operator.

Therefore, there are presently desired a method and an apparatus for easily and precisely sensing the actual fluid ejection timing during the loom operation and monitoring the weft insertion for assuring the optimum weft inserting conditions.

SUMMARY OF THE INVENTION

According to the method of monitoring weft insertion according to the present invention, the jet fluid pressure at the outlet side of the valve unit controlling the supply of the discharge fluid used for impelling the weft yarn into the warp shed is converted into corresponding electrical signals and, when the signals are below the preset value, an alarm is issued or the loom operation discontinued.

According to a preferred embodiment of the present invention, the ejection fluid pressure at the output side of the plural valve units controlling the fluid supply to the main or auxiliary nozzles is converted by pressure detection elements such as piezo-electric elements and, unless all of the electrical signals from the pressure detection elements associated with the respective valve units reach a preset value, the alarm lamp or buzzer is activated or the loom operation discontinued.

The pressure detection element is provided at the discharge fluid outlet side of the valve unit in fluid communication with the fluid supply duct and fitted with the terminal sections for taking the electrical signals. Upon opening the valve unit, the jet fluid flows from the inlet towards the discharge side of the valve unit so that the fluid pressure acts on the detection element. Therefore, by connecting an oscilloscope probe to the terminal unit of the detection unit, the electrical signals converted from the discharge fluid pressure are taken at the oscilloscope and the discharge fluid pressure curve is delineated on the oscilloscope as a function of the opening and closure of the valve unit.

BRIEF DESCRIPTION OF THE DRAWINGS

A more detailed understanding of tne invention may be had from the following description of the preferred embodiments to be read and understood in conjunction witn the accompanying drawings, wherein.

DETAILED DESCRIPTION OF THE PREFERRED EMBODIMENTS

Figure 1:
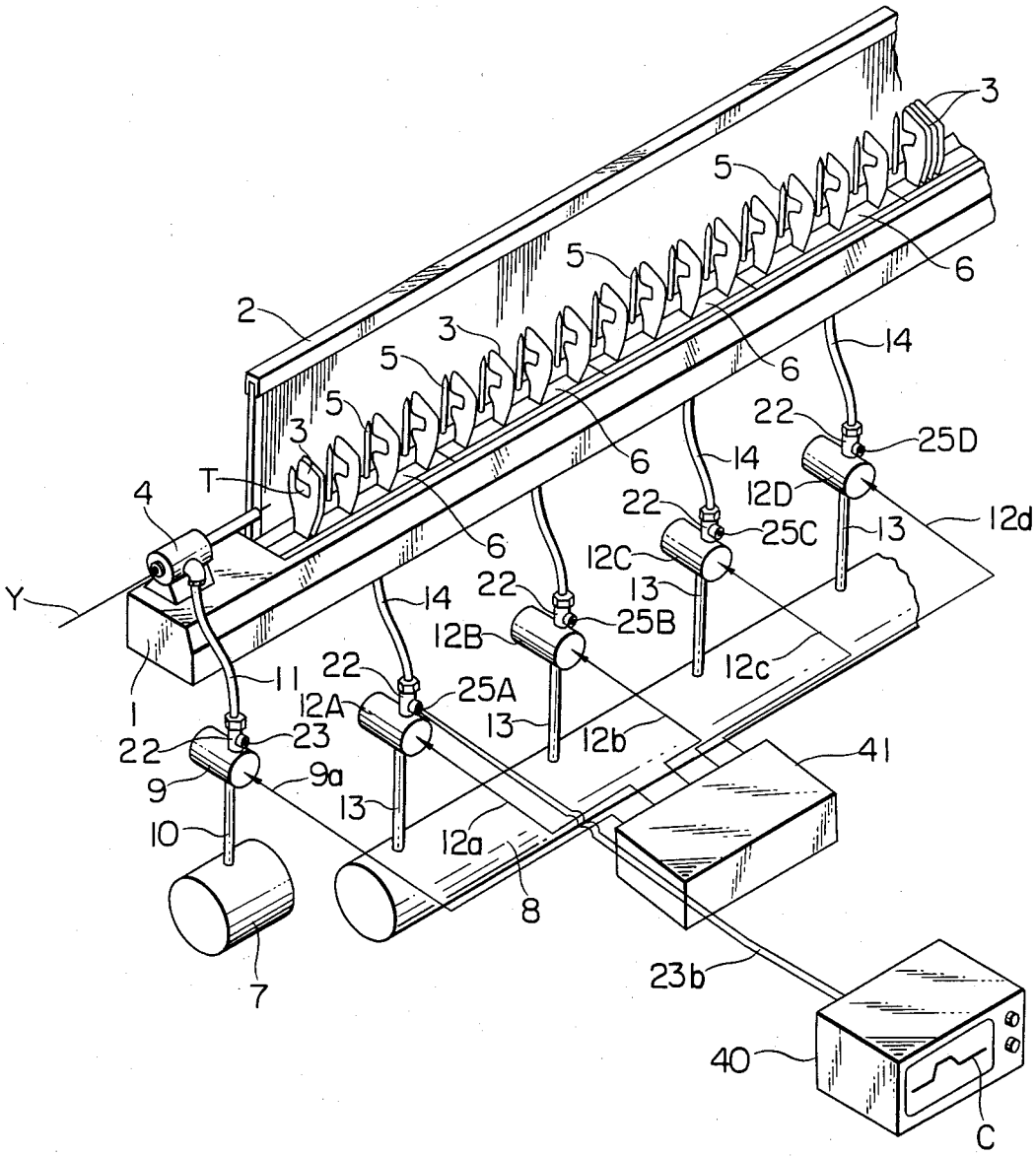
FIG. 1 is a perspective view showing substantial parts of the fluid jet loom embodying the present invention.
Figure 2:
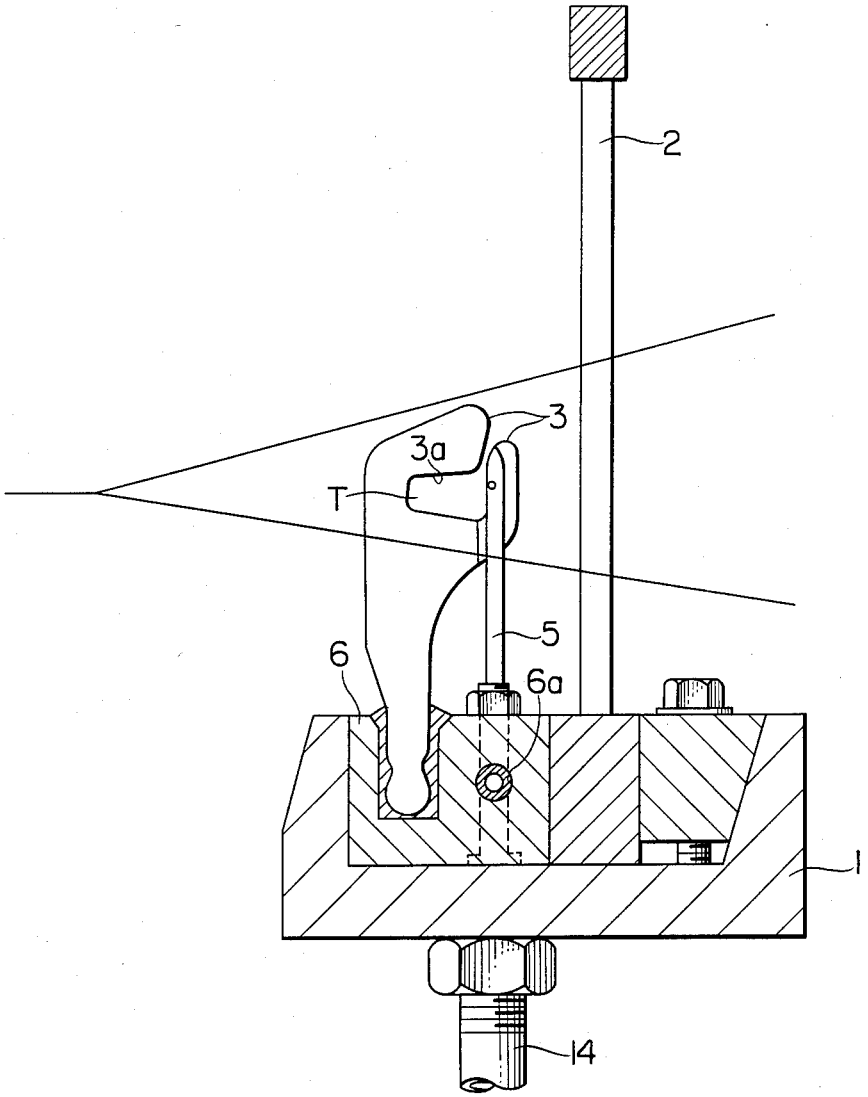
FIG. 2 is an enlarged sectional view of a slay employed in the loom shown in FIG. 1.
Figure 3:
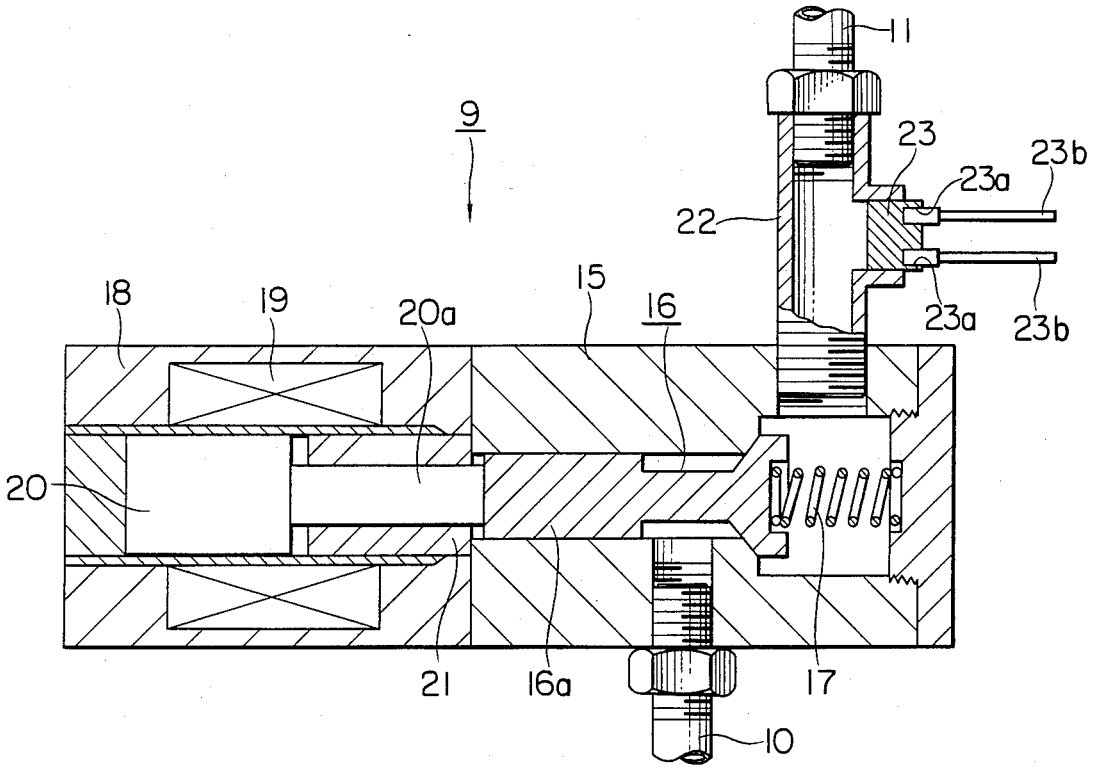
FIG. 3 is an enlarged longitudinal sectional view of the piezo-electric element and the magnetic valve unit employed in the loom shown in FIG. 1.

Referring to FIGS. 1 through 3 showing an embodiment of the present invention applied to, for example, an air jet loom, a large number of weft guide elements 3 are juxtaposed on a slay 1 in opposition to a reed 2, and a weft yarn Y is inserted into a weft yarn guide passage T defined by a row of guide slots 3*a* of the weft yarn guide elements 3 as it is entrained in a pressurized air current supplied from a weft inserting main nozzle 4 mounted on the slay 1. Between the reed 2 and the weft guide member 3, there are mounted upright a plurality of auxiliary nozzles 5 along the length of the weft guide passage T at a constant spacing from one another. Thus, the air jet supplied from the auxiliary nozzles 5 assists in the travel of the weft yarn Y through the weft guide passage T. A plurality of base blocks 6 are arranged on the slay 1 in a straight line with each base block 6 carrying a preset number of the weft guide members 3 and a preset number of the auxiliary nozzles 5.

Below the slay 1, there are mounted a sub-tank 7 for the main nozzle 4 and a sub-tank 8 for the auxiliary nozzles 5 for storage of pressurized air. Between the main nozzle 4 and the sub-tank 7 supplied with pressurized air from a fluid source, not shown, there is interposed an electro-magnetic valve unit 9 in such a manner that a jet fluid in the sub-tank 7 is supplied to the main nozzle 4 through an inlet supply pipe 10, the valve unit 9 and an outlet supply pipe 11. Similarly, between the sub-tank 8 connected to the fluid source and the auxiliary nozzles 5, electro-magnetic valve units 12A, 12B, 12C and 12D similar in construction to the valve unit 9 are associated with the base blocks 6. In the drawing, four such units 12A to 12D are shown. The jet fluid in the sub-tank 8 is supplied into the auxiliary nozzles 5 through inlet supply pipes 13, valve units 12A to 12D and outlet supply pipes 14 connected to fluid conduits 6*a* in the base blocks 6 connected in turn to the associated auxiliary nozzles 5 as shown in FIG. 2. Starting from the valve unit 12A closest to the main nozzle 4, the valve units 12A to 12D are opened sequentially in timed relation with the passage of the weft yarn Y so that the jet fluid is discharged cyclically from the auxiliary nozzles 5 associated with the respective blocks 6, starting from the nozzles 5 associated with the block 6 closet to the main nozzle.

Since the electro-magnetic valve units 9, 12A, 12B, 12C and 12D are of the same construction, only tne valve unit 9 for the main nozzle 4 is hereafter explained.

As shown in FIG. 3, a valve body 16 is disposed within the housing 15 for sliding in the left and right direction, and is biased by a spring 17 in a direction for closing a fluid passage within the housing 15 connecting from the inlet supply pipe 10 to the outlet supply pipe 11. An enclosure cylinder 18 is secured by any suitable means to the left side end of the housing 15 and a solenoid 19 is attached to the inner peripheral surface of the cylinder 18. In the cylinder 18, a plunger 20 is mounted for sliding in the same direction as the valve body 16. A plunger pin 20*a* abuts on a valve piston 16*a* of the valve body 16. As the solenoid 19 is energized, the plunger 20 is attracted by a core 21 so that the plunger pin 20*a* causes the valve body 16 to be displaced against the action of the spring 17 for exposing the fluid passage in the housing 15. The solenoid 19 is connected by a line 9*a* to a control unit 41 as shown in FIG. 1.

In the present embodiment, a connecting pipe section 22 is interposed between the connecting pipe 11 and an outlet passage in the housing 15, and a pressure sensor such as a piezo-electric element 23 is disposed in a suitable aperture in the pipe section 22 so as to contact or to be in fluid communication with a fluid supply passage in the connecting pipe section. A pair of terminal sections 23*a* are provided to the outer surface of the piezo-electric sensor 23 and connected to cables 23*b* connected in turn to a display apparatus such as an oscilloscope 40 as shown by way of example in FIG. 1.

As also shown in FIG. 1, piezo-electric sensor 25A, 25B, 25C and 25D are similarly associated with the electromagnetic valve units 12A to 12D. Also, these valve units 12A to 12D are connected through lines 12*a* to 12*d* to the control unit 41 shown in FIG. 1. Although the piezo-electric elements are used in the present embodiment for pressure detection, and the changes in pressure are directly changed into corresponding electric signals, limit switches, differential transformers or the like devices known in the art in whicn mechanical displacement is induced by the changes in pressure and converted into corresponding electrical signals, may also be used similarly to the piezo-electric sensors.

Figure 4:
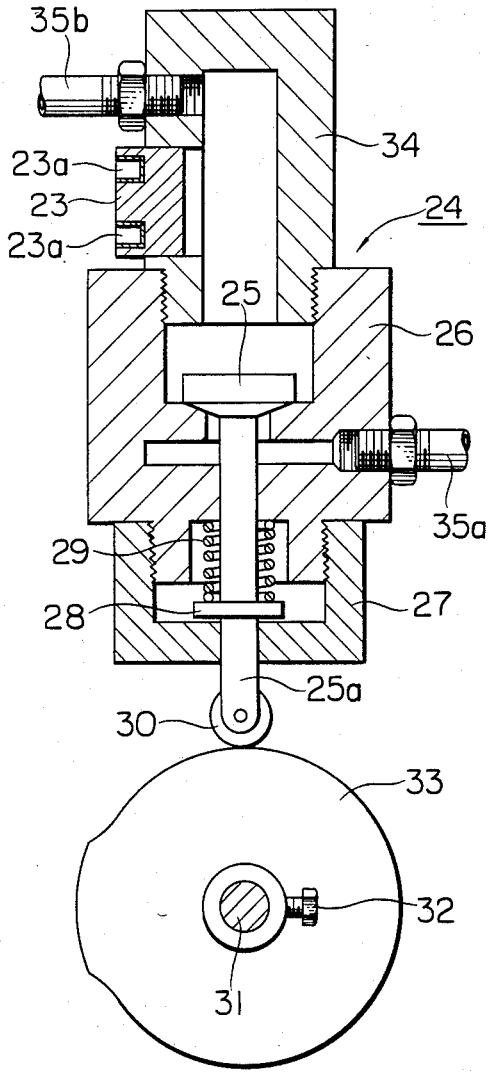
FIGS. 4 and 5 are longitudinal sectional views showing two different modifications of the valve unit.

The present invention may also be implemented with a fluid jet type loom in which a mechanical valve unit 24 shown in FIG. 4 is used in place of the aforementioned electro-magnetic solenoid. In the present modification, a cap member 27 is threadedly attached to the lower end of a housing 26 for a valve body 25, and a valve rod 25*a* connected to the valving member 25 is projected down from the cap member 27. A spring 29 is interposed between a spring retainer 28 attached to the valve rod 25*a* in the cap member 27 and the lower end of the housing 26, and is urged in a direction such that the fluid passage within the housing 26 connecting from an inlet supply pipe 35*a* to an outlet supply pipe as later described is opened or closed by the valve body 25. A roller 30 is mounted for free rotation to the lower end of the valve rod 25*a* and rests on a cam surface of a cam plate 33 secured by a screw 32 to a driving shaft 31 which may be revolved in time with the loom operation. The mounting position of the cam plate relative to the driving shaft 31 can be adjusted with the aid of the screw 32. To the upper end of the housing 26 is threadedly mounted a connection cap member 34 to the peripheral surface of which is threadedly mounted the outlet supply pipe 35*b*connected in turn to the main or auxiliary nozzles. Below the supply pipe 35*b*, piezo-electric elements 23 provided with terminal sections 23*a* are fitted in a suitable aperture in the wall of the cap member for directly communicating with the fluid supply passage in the supply pipe 35*b*.

In the present embodiment, the fluid discharge pressure curve in the jet nozzle is determined by the cam profile of the cam plate 33. When it is desired to adjust the jet timing in dependence upon the width of the woven cloth or the kind of the weft yarn, the tightening degree of the screw 32 need be changed for adjusting the mounting angular position of the cam plate 33. Such angular position adjustment of the cam plate 33 may be easily and accurately achieved by taking at the oscilloscope 40 the electrical signals from the piezo-electric element 23 indicating the prevailing jet fluid pressure as in the preceding embodiment.

It should be noted that the pressure sensor such as the piezo-electric sensor 23 may be mounted at any position provided that the mounting position is at the downstream side of the valve body 25. Thus, the pressure sensor may be mounted in an insertion aperture 26*a* which is provided in the housing 26 instead of the connection cap member 34. Also, the pressure sensor may be mounted to the base of the main nozzle 4 or to the base of a desired one of the auxiliary nozzles 5 instead of the valve unit, although such modification is not shown for simplicity.

The manner in which the weft insertion in the loom having the structure shown in FIGS. 1 to 3 is monitored in accordance with the present invention is hereafter explained by referring to FIGS. 1 to 3, 7 and 8. It snould be noted that the weft insertion in the loom having tne structure of the valve unit shown in FIGS. 4 and 5 may be monitored substantially in the same manner as described hereinbelow as will be apparent to those skilled in the art.

During loom operation, the valve unit 9 is opened in synchronism with the weft insertion for discharging the fluid jet through the main nozzle 4. This causes the weft yarn Y to be propelled from the nozzle 4 and inserted into the weft guided passage T. Also, in synchronism with the timing of the passage of the leading end of the weft yarn Y, the valve units 12A to 12D are sequentially opened under control by the control unit 41 in a known manner and starting from the valve unit 12A closest to the main nozzle 4 so that the fluid discharge from the auxiliary nozzles 5 is achieved sequentially starting from the nozzle 5 closest to the main nozzle 4. The jet fluid pressure in the valve units 9 and 12A to 12D is converted into corresponding electrical signals by the piezo-electric elements 23 and 25A to 25D, these electrical signals being taken at a circuit shown in FIG. 7 through a cable, not shown, which is different from the aforementioned cables 23*b* connected to the oscilloscope 40. The manner in which these electrical signals or the fluid pressure are changed with the occasional rotational angle of the crank shaft of the loom is shown at (a) to (e) in FIG. 8.

Figure 7:
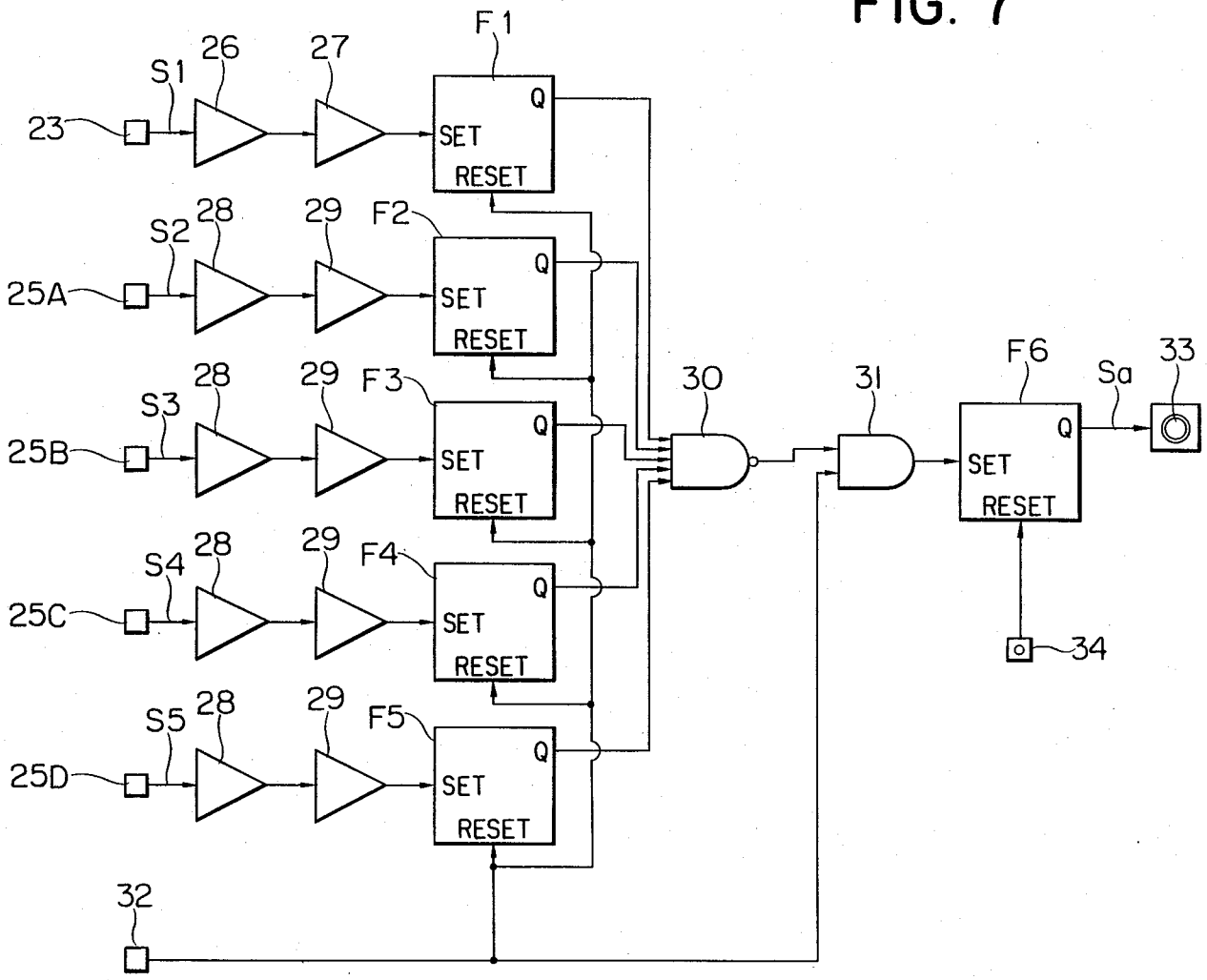
FIG. 7 shows a block diagram of a topical electric circuit used for monitoring weft insertion in accordance with the present invention.

As shown in FIG. 7, the electrical signals outputted from the piezo-electric sensor 23 and indicative of the fluid pressure are introduced through a filter-amplifier 26 and a discrimination circuit 27 to a SET input of a flip-flop circuit F1. The discrimination or switching circuit 27 is designed to switch off a converted signal S1 whenever the signal S1 is below a reference level $V_0$ shown at (a) in FIG. 8. The converted electrical signal S2 supplied from the piezo-electric element 25A is supplied to a SET input of a flip-flop circuit F2 through a filter-amplifier 28 and a discrimination or switching circuit 29. The circuit 29 is designed to switch off a converted electrical signal S2 whenever the signal S2 is below a reference level $V_1$ at (b) in FIG. 8. The converted signals S3, S4 and S5 supplied from the piezo-electric sensors 25B are supplied respectively to SET inputs of flip-flop circuits F3, F4 and F5 through the same circuit as that for the conversion signal S2, that is, the filter-amplifier 28 and the discrimination circuit 29.

Figure 8:
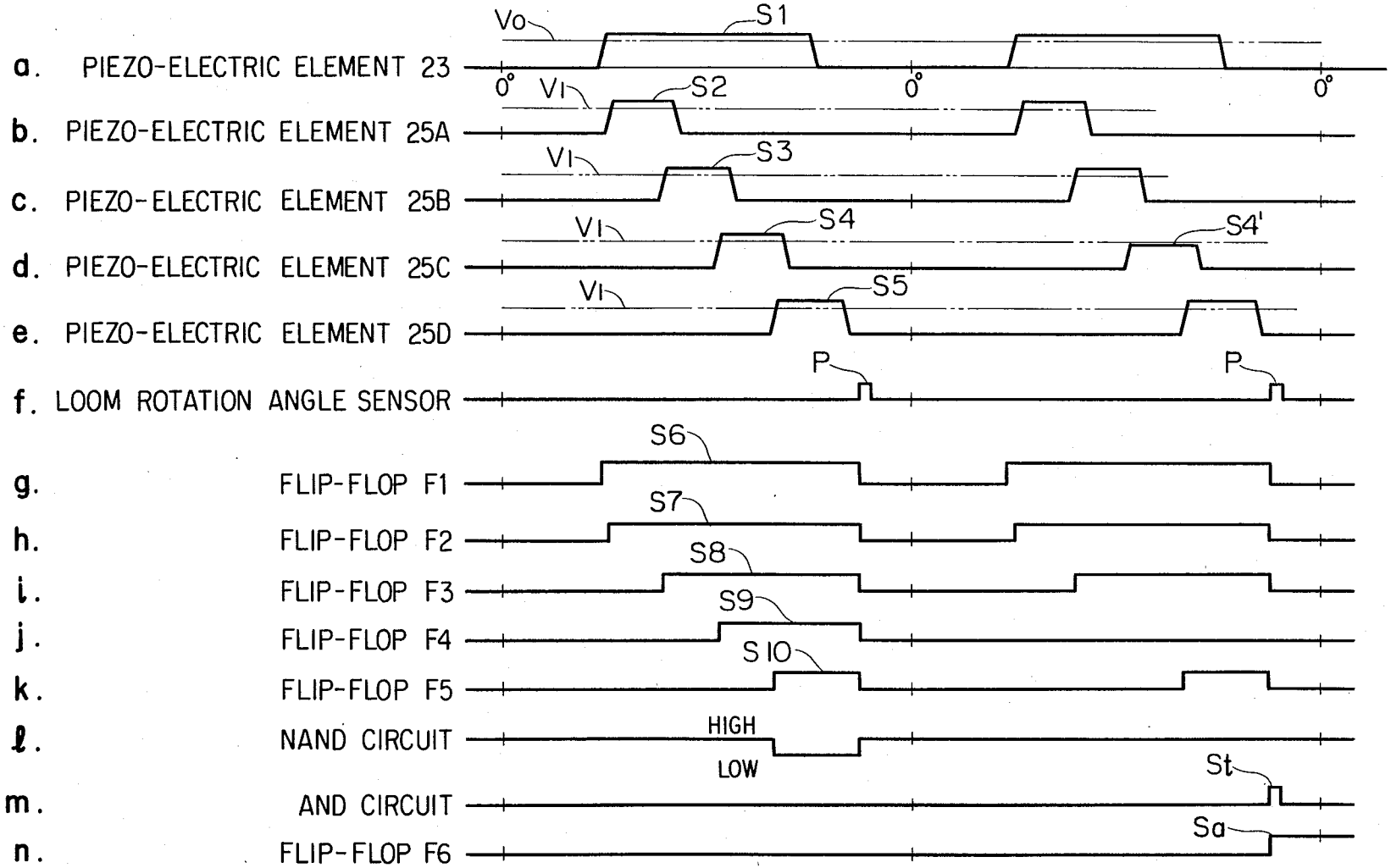
FIGS. 8(*a*) to (*n*) are graphic charts showing the operating states of the various parts of the electrical circuit.

When the converted electrical signals S1 to S5 supplied from the piezo-electric elements 23, 25A to 25D are above the reference levels $V_0$ and $V_1$, signals are outputted from the discrimination circuits 27 and 29 so that high-level signals S6, S7, S8, S9 and S10 are outputted from the flip-flop circuits F1 to F5 as shown at (g) to (k) in FIG. 8 and are supplied to a NAND circuit 30. When the nigh-level signal S10 from the flip-flop circuit F6 is supplied to the NAND circuit 30, the signal outputted from the circuit 30 is inverted from the high level to the low level as shown at (l) in FIG. 8. The output signal from the NAND circuit 30 is introduced into an AND circuit 31, to which a signal indicative of the rotational angle of the loom (P shown at (f) in FIG. 8, hereinafter termed timing signal) is also supplied from a sensor 32 adapted for sensing the rotational angle of the loom, such as conventional rotary encoder. In the present embodiment, the timing signal P is outputted directly after closure of the electro-magnetic valve unit 12D. Thus, the output signal level from the AND circuit 31 is determined on the basis of the timing signal P and a combination of the output signals from the flip-flop circuits F1 to F5 that are obtained after the fluid discharge from the main nozzle 4 and the auxiliary nozzle 5 and the insertion of one weft yarn are terminated. When the electro-magnetic valve units 9 and 12A to 12D are operating properly in the manner described hereinabove, no signals are outputted by the NAND circuit 30.

The timing signal P from the sensor 32 is supplied to the RESET terminals of the flip-flop circuits F1 to F5, at which time the output signals from these flip-flop circuits are inverted to the low level as indicated at (g) to (k) in FIG. 8.

When the valve unit 12C, for instance, is not operating properly and the converted electric signal S4' from the piezo-electric sensor 25C is below the reference level $V_1$, the output signal S9 from the flip-flop circuit F4 remains at a low level, as shown at (j) in FIG. 8. Thus, even when the output signal S10 from the flip-flop circuit F5 is supplied to the NAND circuit 30, the output signal from the NAND circuit 30 is not inverted but remains at a high level as indicated at (l) in FIG. 8. When the timing signal P supplied from the loom rotation angle sensor 32 is supplied to the AND circuit 31, a trouble signal St is outputted from the circuit 31 as indicated at (m) in FIG. 8, which signal is introduced to the SET input of the flip-flop circuit F6. The result is that an alarm signal Sa is outputted from the flip-flop circuit F6 as indicated at (n) in FIG. 8 and an alarm lamp 33 is illustrated by the signal Sa. Thus, with the alarm lamp 33 turned on, the operator is informed that one of the valve units 9 and 12A to 12D is not operating properly and thus may proceed to remove the cause of trouble of the valve unit 12C that may give rise to the error in weft insertion.

The flip-flop circuit F6 can be reset by the operation of an operating button 34.

In this manner, the operating state of a plurality of electro-magnetic valve units operating at a nigh speed can be checked at all times in the present embodiment thus providing for a proper control of the operating state of the electro-magnetic valve unit on which depends the optimum weft inserting operation. That is, the optimum weft insertion may be assured at all times on the basis of the actual operating state of the valve units during the loom operation.

The terminal sections of the piezo-electric elements 23 of the valve units 9 and 12A to 12D are connected to the oscilloscope 40 through line **23*b* as shown in FIGS. 1 and 3, as described above. When it is assumed that the oscilloscope probe is connected to the terminal sections 23*a* of the valve unit 12A shown in FIG. 1, the fluid pressure in the connecting pipe section 22 is converted by the piezo-electric element 23 into corresponding electrical signals, which signals are indicated as discharge fluid jet pressure curve C on the oscilloscope 40. In this manner, it is possible to accurately grasp the first and last transition states, fluid discharge period, start and stop of jet discharge and the fluid discharge pressure per se at the auxiliary valves 5 controlled oy the valve unit 12A, and accordingly to make a check whether or not the actual start and stop timing of fluid discharge at the auxiliary nozzle 5 during the loom operation is coincident with the preset timing. Should difference exist between the two, the command program for the electro-magnetic valve unit 12A in the control unit 41 can be suitably modified for accurately setting the fluid discharge timing at the auxiliary nozzle. In this manner, it is possible to grasp how the preset ejection timing is changed in the course of the actual loom operation. Also, when the electrical command signals from the control unit 41 are supplied to the electro-magnetic valve unit 12A, it is possible to grasp whether or not the opening and closure state of the valve body 16** is in accordance with the electrical command signals.

Likewise it is possible to measure the discharge fluid pressure in the remaining valve units 12B to 12D and, based on the comparison of the respective fluid pressure curves, to determine the effective distribution of the jet fluid for the sequential fluid discharge for possibly reducing the consumption of the jet fluid.

These various advantages are derived from using the pressure sensors such as piezo-electric sensor 23 for converting the fluid pressure at the discharge side of the valve units 9 and 12A to 12D into corresponding electrical signals. Above all, the piezo-electric sensor 23 is highly insusceptible to factors other than the fluid pressure, such as changes in temperature, while it can be operated extremely easily because there is no necessity of carrying out zero point compensation of the electrical signals with each measurement of the ejection timing at the ejection nozzles. Also, the piezo-electric elements 23 are low in costs and, even in instances wherein a large number of the valve units are employed in the fluid jet loom and the piezo-electric sensors 23 are mounted to the respective valve units, the investment costs can be drastically lowered.

Figure 9:
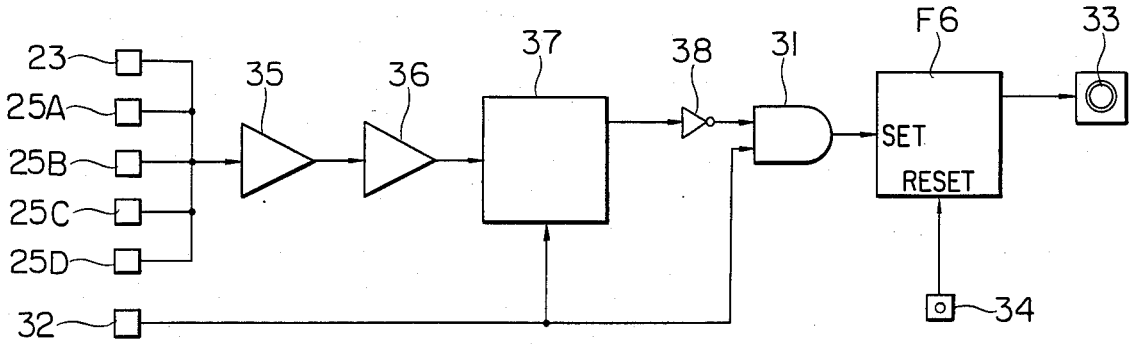
FIGS. 9 and 10 are block diagrams showing two different examples of the electrical circuit employed for monitoring the weft insertion in accordance with the present invention.

FIG. 9 shows a modified circuit for monitoring the operating state of the electro-magnetic valve units of the present invention. In the present embodiment, the converted electrical signals from the piezo-electric sensors 23 and 25A to 25D are supplied to a filter-amplifier 35 and a discrimination circuit 36. The circuit 36 issues a pulse signal each time a conversion signal is supplied thereto from the sensors 23 and 25A to 25D, which pulse signal is supplied to a counter circuit 37. The counter circuit 37 issues a high level signal for every five pulse signals supplied thereto, which high level signal is inverted by an inverting amplifier 38 to a low level signal which is supplied to an AND circuit 31. The timing signal from the loom rotating angle sensor 32 is supplied to the AND circuit 31 and the counter cirucit 37. At this time, only the counter circuit 37 is reset while there is no output signal issued from the AND circuit 31.

When one of the valve units 9 and 12A to 12D is not operating properly, only four pulse signals are supplied to the counter circuit 37 and, at the instant that the timing signal P is issued from the loom rotation angle sensor 32, both input signals to the AND circuit 31 are at a high level. Thus, the circuit 31 issues a high level signal to a flip-flop circuit F6 for lighting the alarm lamp 33.

Figure 10:
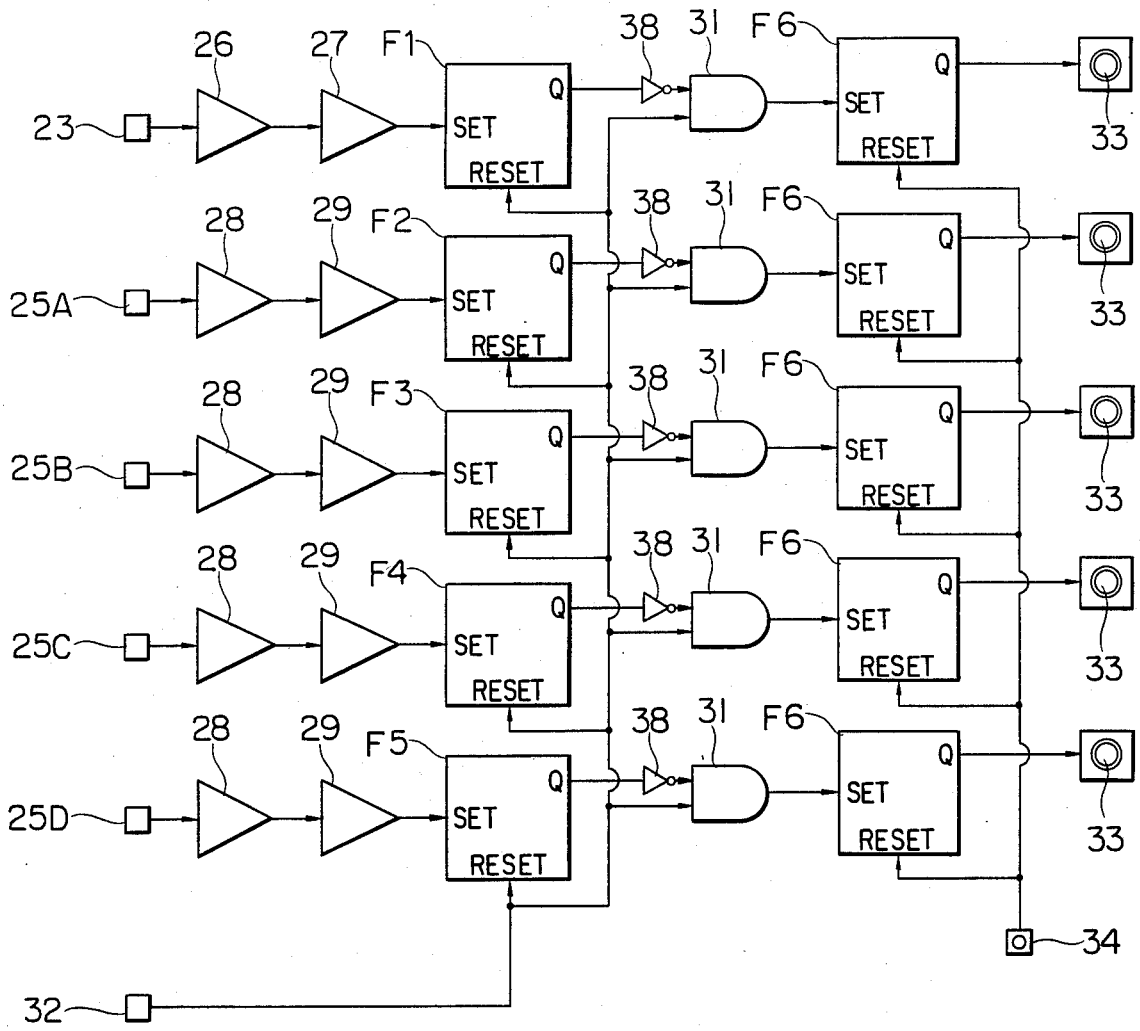

In a modification shown in FIG. 10, alarm lamps 33 may be respectively associated with the piezo-electric sensors 23 and 25A to 25D provided to the electro-magnetic valve units 9 and 12A to 12D.

In the present modification, to each of the flip-flop circuits F1 to F5 are associated an inverting amplifier 38, AND circuit 31 and a flip-flop circuit F6 shown in FIG. 8, in such a manner that, when one of the valve units 9 and 12A to 12D, such as unit 12C, is not operating properly, the alarm lamp 33 associated with the valve unit **12*c*** is illuminated. In this manner, the valve unit in trouble can be located instantly.

In a further modification of the present invention, a limit switch may be employed in place of the piezo-electric sensor, which limit switch may be turned on when the fluid pressure exceeds a preset valve for activating an alarm lamp or buzzer or causing the standstill of the loom.

Figure 5:
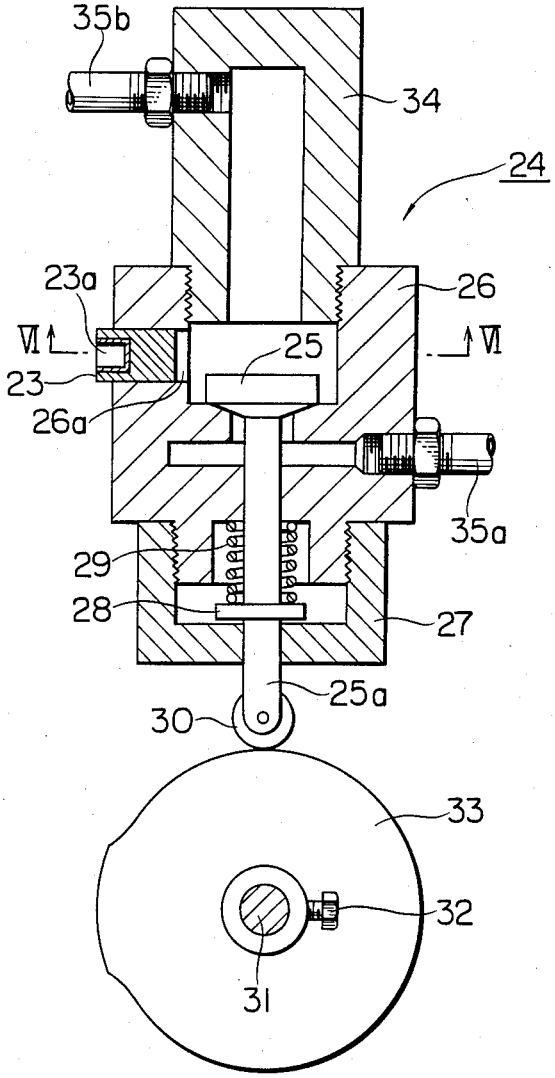
Figure 6:
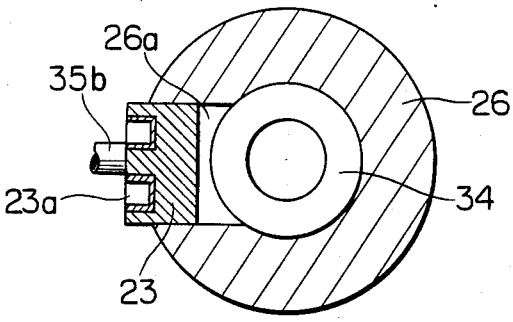
FIG. 6 is a transverse sectional view taken along line VI—VI of FIG. 5.

Although the electro-valve units are used in the aforementioned control circuits, similar control circuits may be used in conjunction with the mechanical valve units making use of a cam and a cam follower roller shown in FIGS. 4 and 5 for monitoring the weft insertion in the loom. In addition, although the description has been made hereinabove in connection with the shuttleless loom making use of pressurized air as the weft impelling fluid, the present invention can be implemented when pressurized water is used as the impelling fluid, in a manner which is apparent to those skilled in the art.

What is claimed is:

1. A method of monitoring the weft insertion in a fluid jet type loom in which the supply of the jet discharge fluid impelling the weft yarn into the open shed of the warp yarn is controlled by a valve unit, characterized in that the jet fluid pressure on the output side of the valve unit is sensed by a pressure detection element which generates electrical signals varying in magnitude proportionately with variations in said pressure, and alarm or cessation of the loom operation is caused when the signals are below a preset value.

2. An apparatus for monitoring the weft impelling fluid pressure in a fluid jet loom in which the supply of the jet fluid used for impelling the weft yarn into the open warp shed is controlled by a valve unit, said apparatus characterized in that a pressure detection element is mounted on the fluid discharge side of the valve unit and in communication with a fluid supply passage for supplying the jet fluid, and provided with terminal sections for taking electrical signals coupled to an emergency detection electrical circuit.

3. The apparatus as claimed in claim 2, characterized in that said pressure detection element is mounted between the valve unit and a jet nozzle supply pipe at the discharge side of the valve unit.

4. The apparatus as claimed in claim 2, characterized in that the pressure detection element is a piezo-electric sensor.

5. The apparatus as claimed in claim 2, characterized in that a plurality of valve units are provided and associated with separate pressure detection elements, and in that the emergency detection electrical circuit comprises plural discriminating means connected separately to said terminal sections of the pressure detection elements for discriminating said electrical signals supplied from said terminal sections, said discriminating means issuing output signals when said electrical signals are above a reference level, plural flip-flops separately connected to these discriminating means and outputting high-level signals upon reception of said output signals, and means connected to said flip-flops for issuing emergency signals unless all of said flip-flops issue high-level signals.

6. The apparatus as claimed in claim 5, characterized in that said means for issuing emergency signals comprises a NAND circuit connected in series with said plural flip-flops and an AND circuit connected in series with said NAND circuit.

7. The apparatus as claimed in claim 5, characterized in that a plurality of said emergency signal issuing means are provided and connected in series with respective ones of said flip-flops.

8. The apparatus as claimed in claim 2, characterized in that a plurality of valve units are provided and associated with separate pressure detection elements, and in that the emergency detection electrical circuit comprises a discrimination circuit connected to the terminal sections of the pressure detection elements for discriminating said electrical signals supplied from said terminal sections, and issuing output signals each time said electrical signals are above a reference level, a counter circuit connected to said discriminating circuit for counting the number of output signals from said discriminating circuit, and means connected to said counter circuit for issuing an emergency signal when the count number is not coincident with the number of the electrical signals.

9. The apparatus as claimed in claim 2, characterized in that said valve unit is an electro-magnetic unit.

10. The apparatus as claimed in claim 2, characterized in that the valve unit is driven by a cam and cam follower drive system.

* * * * *